US011564477B1

(12) United States Patent
Chao et al.

(10) Patent No.: US 11,564,477 B1
(45) Date of Patent: Jan. 31, 2023

(54) PORTABLE CUP HOLDER

(71) Applicants: Yi-Chun Chao, Xianxi Township, Changhua County (TW); Chueh-Ying Huang, Xianxi Township, Changhua County (TW)

(72) Inventors: Yi-Chun Chao, Xianxi Township, Changhua County (TW); Chueh-Ying Huang, Xianxi Township, Changhua County (TW)

( * ) Notice: Subject to any disclaimer, the term of this patent is extended or adjusted under 35 U.S.C. 154(b) by 0 days.

(21) Appl. No.: 17/492,802

(22) Filed: Oct. 4, 2021

(51) Int. Cl.
*A45F 3/14* (2006.01)
*B65D 71/50* (2006.01)

(52) U.S. Cl.
CPC ..... *A45F 3/14* (2013.01); *B65D 71/50* (2013.01)

(58) Field of Classification Search
CPC ..... A45F 3/14; B65D 71/50
USPC ..... 224/148.6, 148.7, 148.4; 220/754, 738; 206/428; 294/159, 143, 161
See application file for complete search history.

(56) References Cited

U.S. PATENT DOCUMENTS 2,961,124 A * 11/1960 Hunter ..... B65D 25/00 220/62.12
3,734,336 A * 5/1973 Rankow ..... B65D 25/32 220/592.2
3,848,766 A * 11/1974 Gantt ..... B65D 25/287 206/139
4,165,814 A * 8/1979 Seel ..... B65D 77/28 215/229
5,165,583 A * 11/1992 Kouwenberg ..... B65D 81/3827 220/4.24
5,413,261 A * 5/1995 Wu ..... A47J 41/0083 215/396
5,573,136 A * 11/1996 Page ..... A47G 23/0616 220/761
5,873,616 A * 2/1999 Kirschbaum ..... B65G 7/12 294/154
5,890,635 A * 4/1999 Wu ..... B65D 23/108 224/257
7,721,892 B2 * 5/2010 Hortel ..... A45F 5/00 294/87.28
8,602,253 B2 * 12/2013 Beltrante ..... A47G 23/0208 220/6
9,834,349 B1 * 12/2017 Gallagher ..... B65D 23/108
D862,987 S * 10/2019 Bergin ..... D7/553.4
(Continued)

*Primary Examiner* — Nathan J Newhouse
*Assistant Examiner* — Lester L Vanterpool
(74) *Attorney, Agent, or Firm* — Alan D. Kamrath; Karin L. Williams; Mayer & Williams PC

(57) ABSTRACT

A portable cup holder contains: multiple placing sheets, a connection shaft, and a first carry strap. A respective placing sheet includes a receiving orifice defined on a first side thereof, and the respective placing sheet includes a rotating orifice formed on a second side thereof. The connection shaft is inserted through the rotating orifice of the respective placing sheet to rotate the respective placing sheet along the connection shaft, and the connection shaft includes a hollow orifice and a partition post horizontally extending in the hollow orifice. The first carry strap is formed in a ring shape and includes an accommodation space defined inside the first carry strap, the partition post of the connection shaft is received in the accommodation space of the first carry strap so that the first carry strap is connected with the connection shaft and is pulled to the partition post upward or downward.

10 Claims, 8 Drawing Sheets

(56) References Cited

U.S. PATENT DOCUMENTS

| | | | | |
|---|---|---|---|---|
| 10,638,828 | B2 * | 5/2020 | Wang | A45F 5/1026 |
| 2004/0031806 | A1 * | 2/2004 | Jackson | B65D 25/287<br>220/754 |
| 2010/0116704 | A1 * | 5/2010 | Longley | A47G 23/0616<br>206/427 |
| 2014/0014552 | A1 * | 1/2014 | Pokora | A47G 23/0208<br>220/737 |
| 2020/0146479 | A1 * | 5/2020 | Verbeeck | A47G 23/02 |

* cited by examiner

PORTABLE CUP HOLDER

BACKGROUND OF THE INVENTION

Field of the Invention

The present invention relates to a cup holder, and more particularly to a portable cup holder to accommodate at least one drink cup.

Description of the Prior Art

Take-out drink cups are usually held directly with users' hands or packed in plastic bags and then held with the users' hands to be portable outdoor. However, to comply with environmental protection requirements, the plastic bags originally provided by the stores have been reduced or even not provided. Only for the sake of convenience and safety, it is essential to be portable take-out beverage cups. Therefore, some stores have changed to use mesh bags or paper bags to store drink cups. However, such a portable manner will tilt the drink cups to leak liquids from the drink cups.

A conventional carry strap for portable drink cup has been developed and contains a fitting ring and a circular accommodation space defined inside the fitting ring, wherein a conical shape of the drink cup will retain the drink cup in the circular accommodation space, and an arcuate grip loop is located on the fitting ring, and two ends of the arcuate grip loop are connected with two sides of an upper rim of an outer wall of the fitting ring so that a user carries the drink cup easily. But the carry strap is configured to be portable a single drink cup merely, so only sole drink cup is portable by using the conventional carry strap to cause inconvenient using.

The present invention has arisen to mitigate and/or obviate the afore-described disadvantages.

SUMMARY OF THE INVENTION

The primary object of the present invention is to provide a portable cup holder which is capable of rotating multiple placing sheets based on using requirements to change the portable cup holder, such that at least one to multiple drink cups are carried to enhance using convenience and utility.

To obtain above-mentioned aspect, a portable cup holder provided by the present invention contains: multiple placing sheets, a connection shaft, and a first carry strap.

A respective placing sheet includes a receiving orifice defined on a first side thereof, and the respective placing sheet includes a rotating orifice formed on a second side thereof.

The connection shaft is inserted through the rotating orifice of the respective placing sheet to rotate the respective placing sheet along the connection shaft, and the connection shaft includes a hollow orifice and a partition post horizontally extending in the hollow orifice.

The first carry strap is formed in a ring shape and includes an accommodation space defined inside the first carry strap, the partition post of the connection shaft is received in the accommodation space of the first carry strap so that the first carry strap is connected with the connection shaft and is pulled to the partition post upward or downward.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
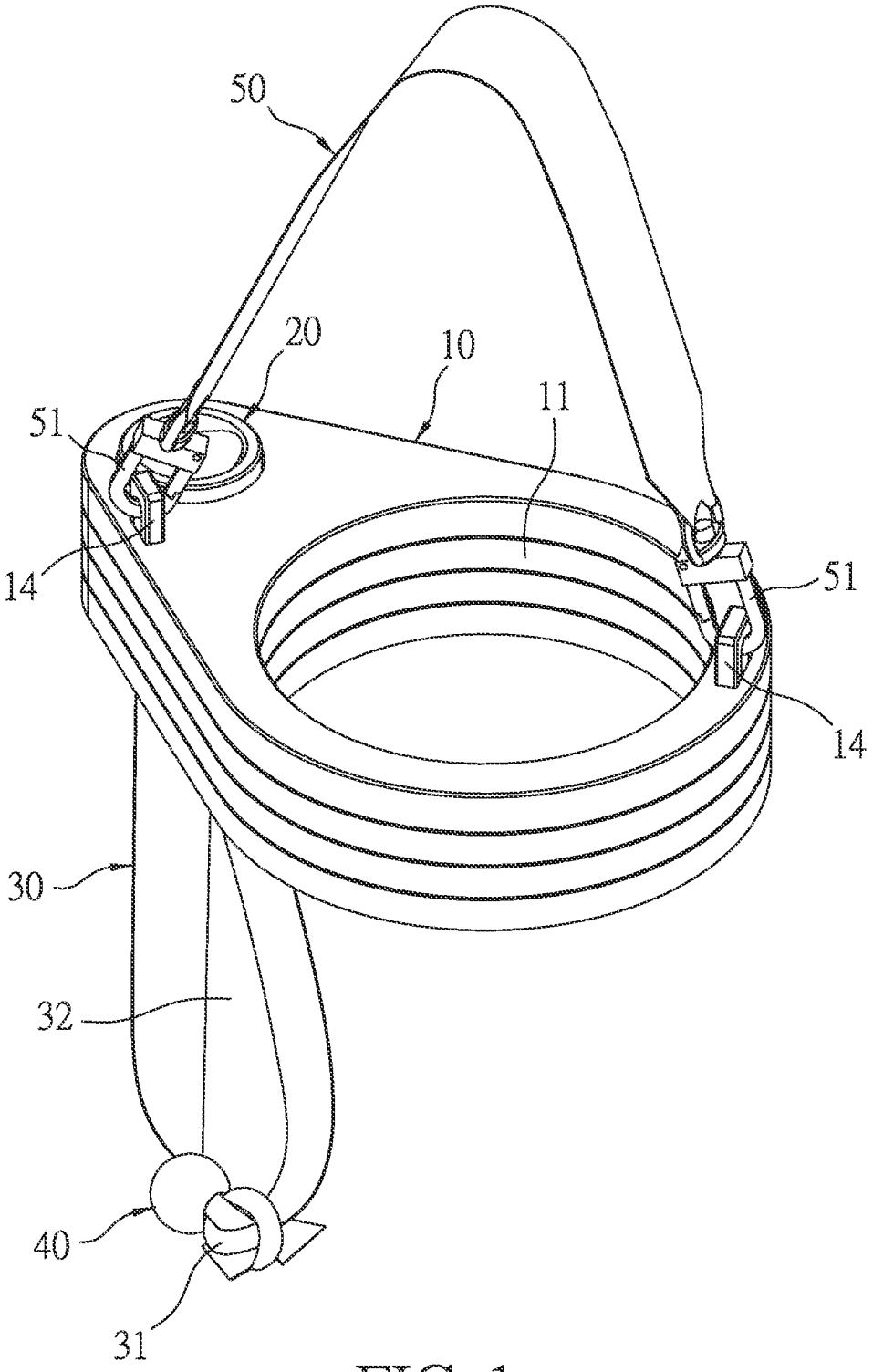
FIG. 1 is a perspective view showing the assembly of a portable cup holder according to a preferred embodiment of the present invention.
Figure 2:
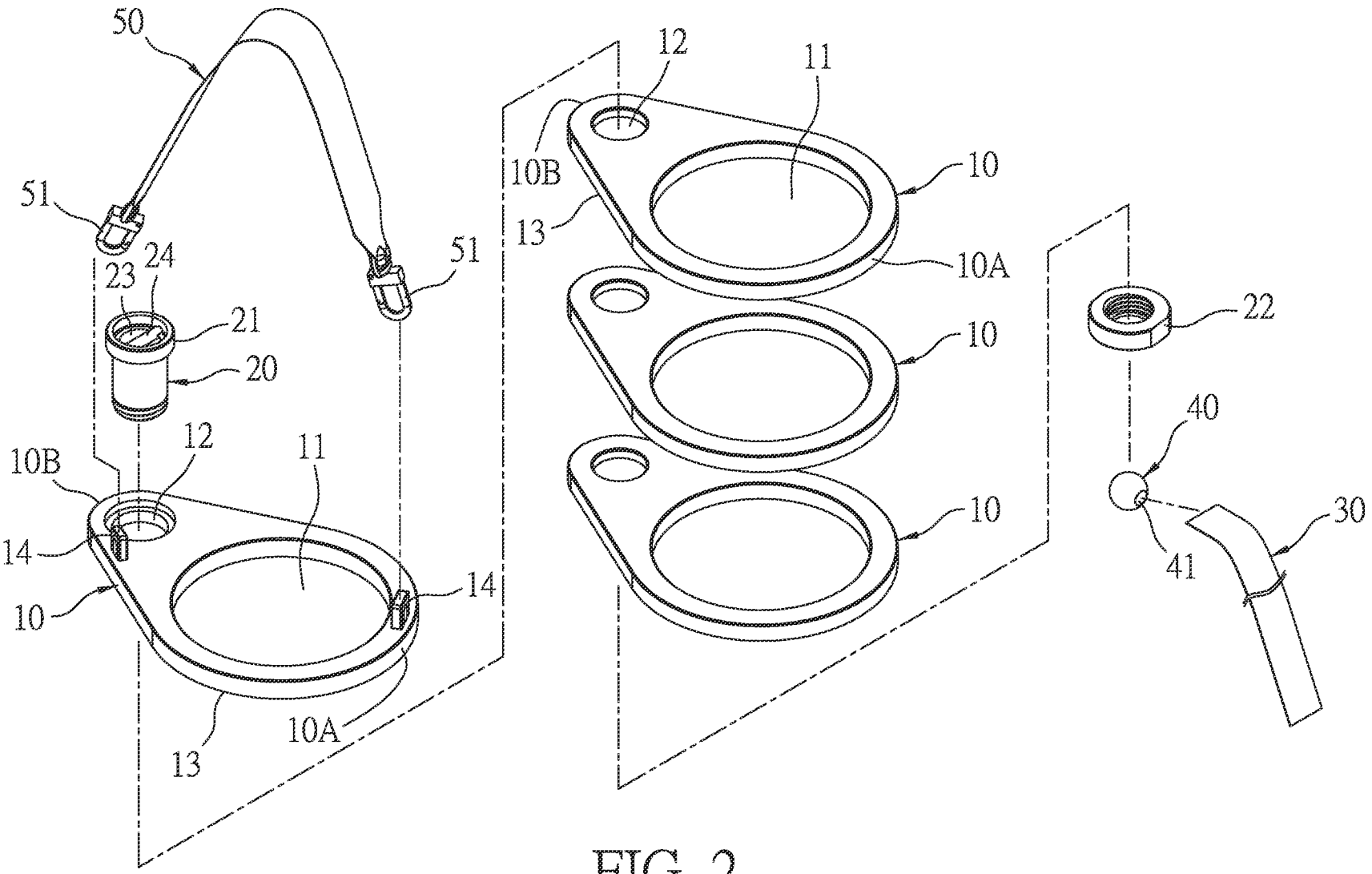
FIG. 2 is a perspective view showing the exploded components of the portable cup holder according to the preferred embodiment of the present invention.
Figure 3:
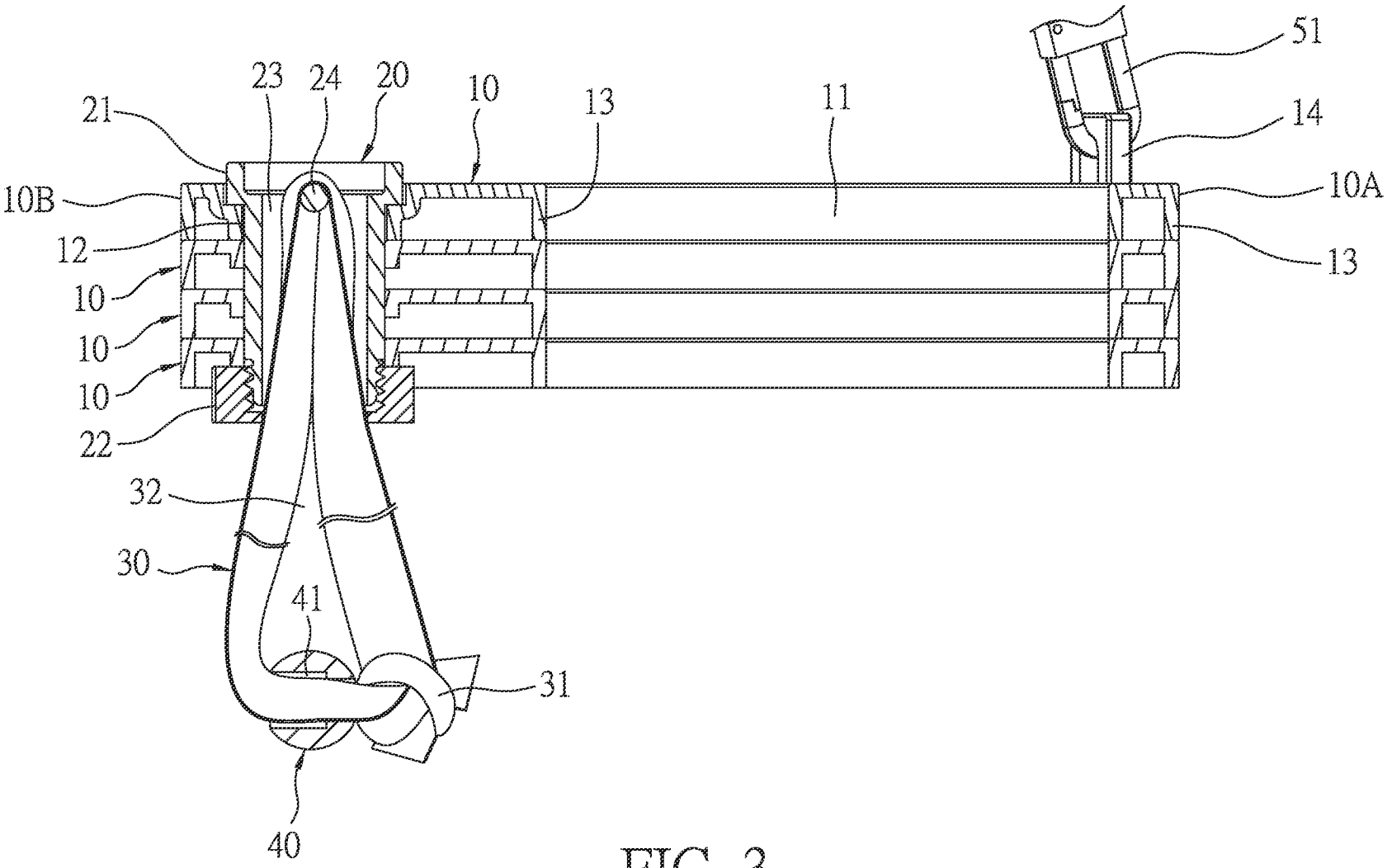
FIG. 3 is a cross sectional view showing the assembly of the portable cup holder according to the preferred embodiment of the present invention.

With reference to FIGS. 1-3, a portable cup holder according to a preferred embodiment of the present invention comprises multiple placing sheets 10, a connection shaft 20, a first carry strap 30, a defining element 40, and a second carry strap 50.

The multiple placing sheets 10 are stacked, a respective placing sheet 10 includes a receiving orifice 11 defined on a first side thereof, and the respective placing sheet 10 includes a rotating orifice 12 formed on a second side of the respective placing sheet 10. In this embodiment, the respective placing sheet 10 is formed in a water droplet shape, and the respective placing sheet 10 further includes a largest-diameter segment 10A and a small-diameter segment 10B. The receiving orifice 11 is defined on the first side of the respective placing sheet 10 adjacent to the largest-diameter segment 10A, the rotating orifice 12 is formed on the second side of the respective placing sheet 10 proximate to the small-diameter segment 10B, wherein the respective placing sheet 10 includes a protruded fringe 13 extending from a peripheral side thereof and a peripheral side of the receiving orifice 11, a topmost placing sheet 10 of the multiple placing sheets 10 further includes two connection seats 14 located adjacent to the largest-diameter segment 10A and the small-diameter segment 10B, and the rotating orifice 12 of the topmost placing sheet 10 is two stepped shape.

The connection shaft 20 includes an expansion portion 21 extending from a top thereof and is inserted through the rotating orifice 12 of the respective placing sheet 10, The expansion portion 21 of the connection shaft 20 abuts against the two stepped shape of the rotating orifice 12 of the topmost placing sheet 10. The connection shaft 20 further includes a locking ring 22 screwed with a bottom thereof, such that the connection shaft 20 fixes the multiple placing sheets 10 by using the expansion portion 21 and the locking ring 22, and the respective placing sheet 10 rotates along the connection shaft 20. The connection shaft 20 includes a hollow orifice 23 and a partition post 24 horizontally extending in the hollow orifice 23.

The first carry strap 30 includes two ends which are tied to produce a knot 31 and to form in a ring shape, and the first carry strap 30 includes an accommodation space 32 defined thereinside. The partition post 24 of the connection shaft 20 is received in the accommodation space 32 of the first carry strap 30 so that the first carry strap 30 is connected with the connection shaft 20 and is pulled to the partition post 24 upward or downward.

The defining element 40 is formed in a circular ball shape and is mounted below the partition post 24. The defining element 40 includes a through hole 41 configured to connect with the first carry strap 30.

The second carry strap 50 includes two coupling portions 51. In this embodiment, a respective coupling portion 51 is a snap hook so as to hook with and remove from a respective connection seat 14 of the topmost placing sheet 10.

Figure 4:
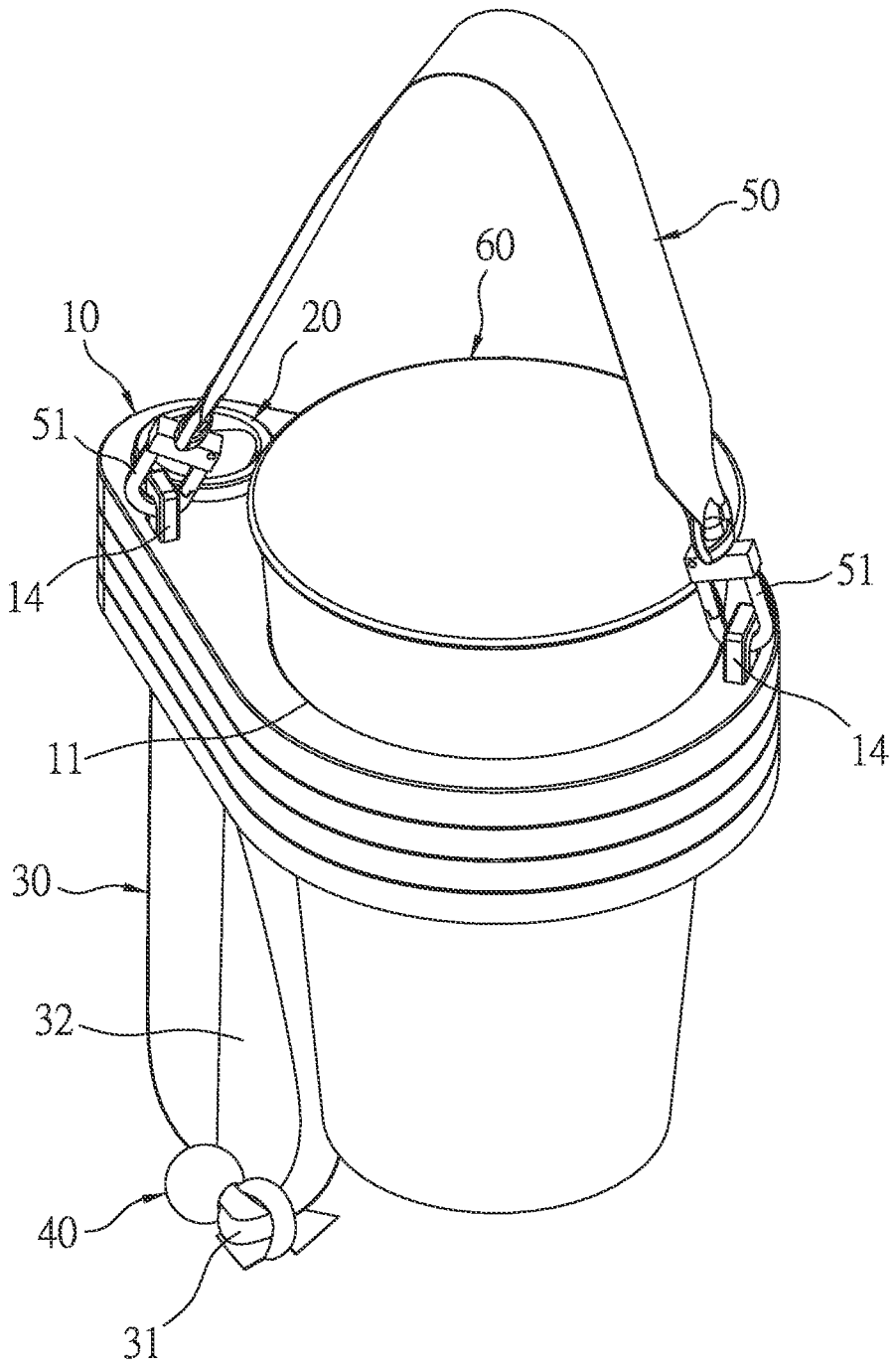
FIG. 4 is a perspective view showing the operation of the portable cup holder according to the preferred embodiment of the present invention.

In use, as shown in FIG. 4, the multiple placing sheets 10 are aligned and stacked together so that multiple receiving orifices 11 of the multiple placing sheets 10 accommodate a drink cup 60, and the second carry strap 50 is gripped by a user, thus carrying the drink cup 60 easily.

Figure 5:
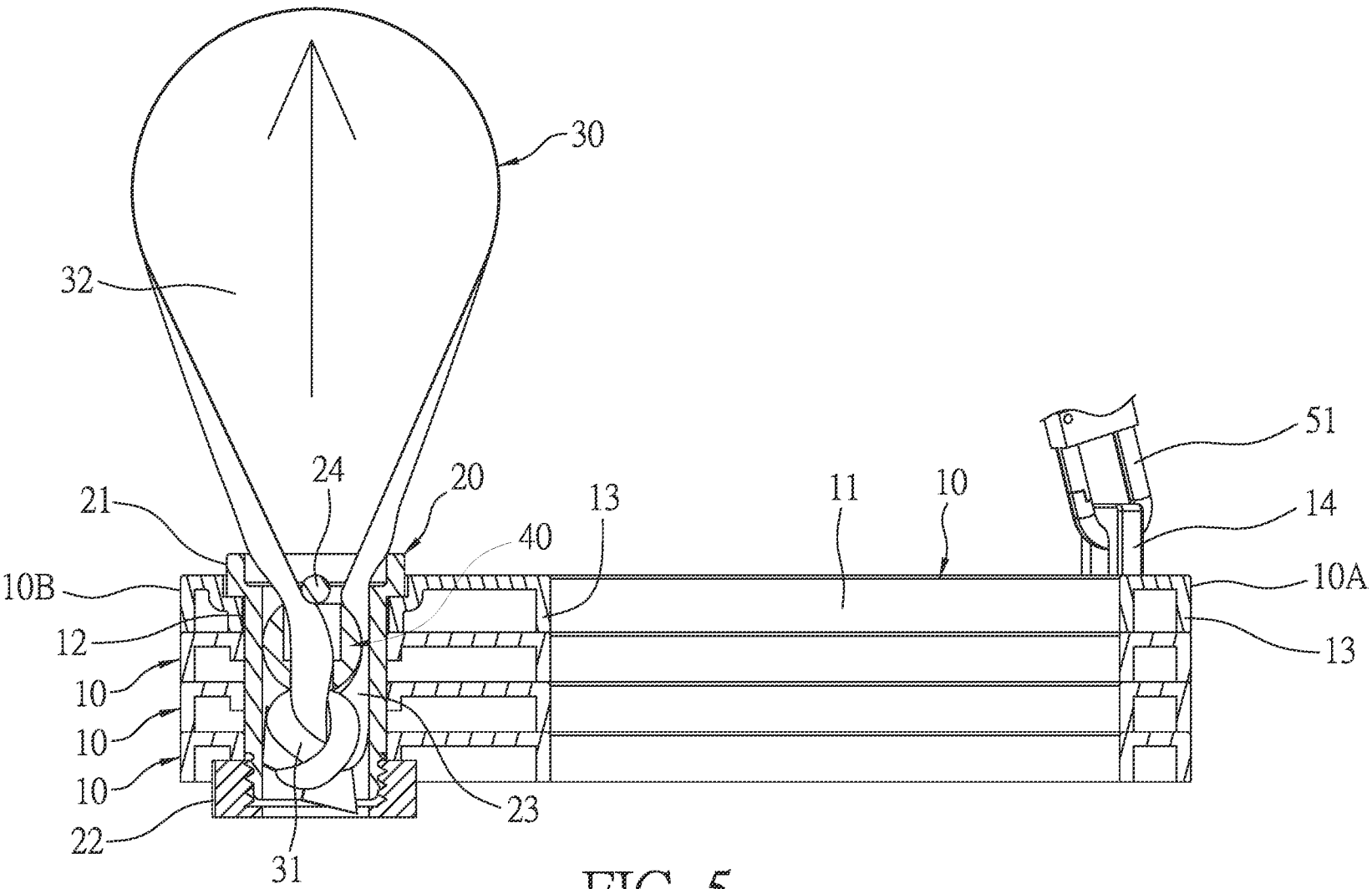
FIG. 5 is a cross sectional view showing the operation of the portable cup holder according to the preferred embodiment of the present invention.
Figure 6:
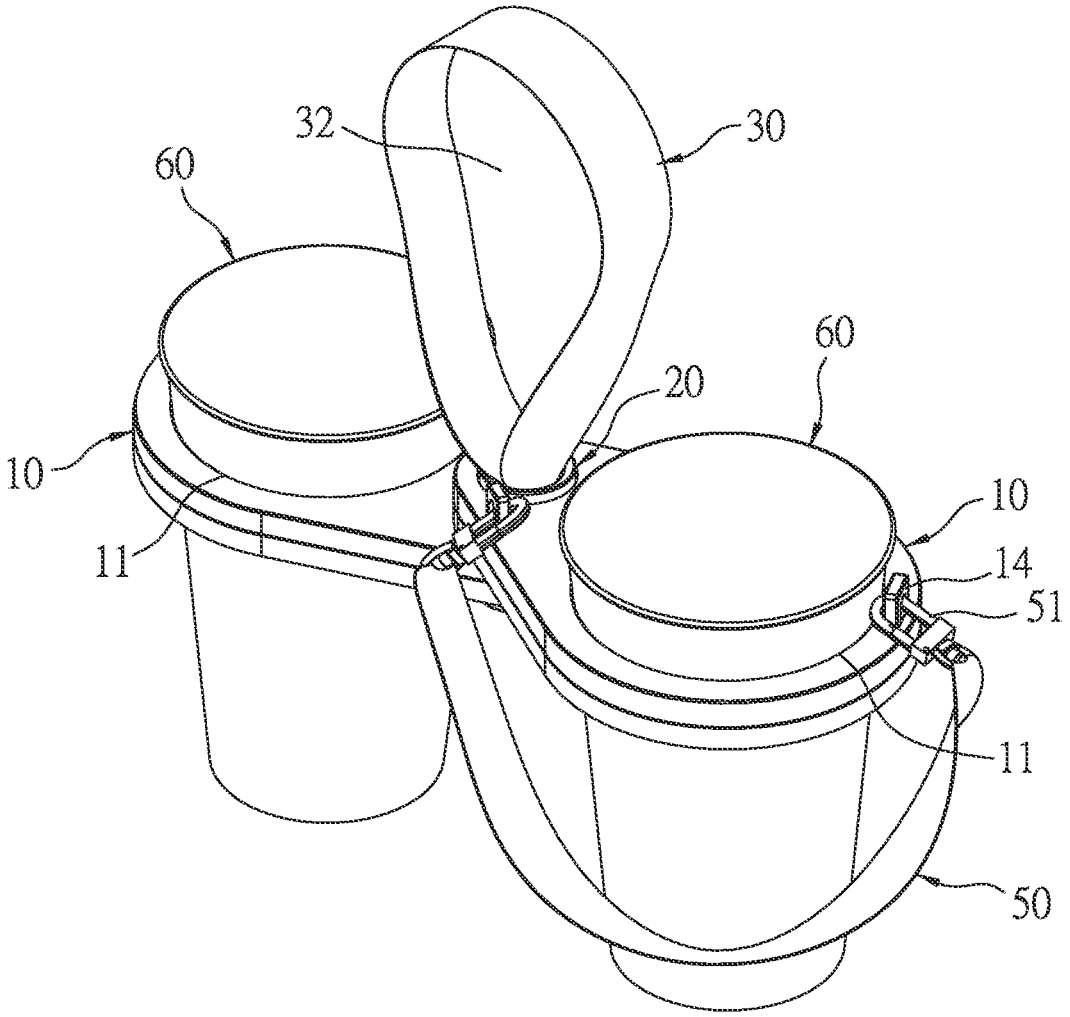
FIG. 6 is a perspective view showing the operation of the portable cup holder according to the preferred embodiment of the present invention.

Referring to FIG. 5, the first carry strap 30 is pulled upward to the partition post 24 so that the knot 31 of the first carry strap 30 is engaged into the hollow orifice 23 of the connection shaft 20 to be positioned by the partition post 24, wherein the first carry strap 30 is fixed by the partition post 24 which matches with the defining element 40 to avoid an oblique of the first carry strap 30. As shown in FIG. 6, the multiple placing sheets 10 are rotated along the connection shaft 20 so as to separate the multiple placing sheets 10 into two corresponding portions of the multiple placing sheets 10. Thus, the multiple receiving orifices 11 of two corresponding portions of the multiple placing sheets 10 accommodate two drink cups 60, and the first carry strap 30 carries the two drink cups 60 together.

Figure 7:
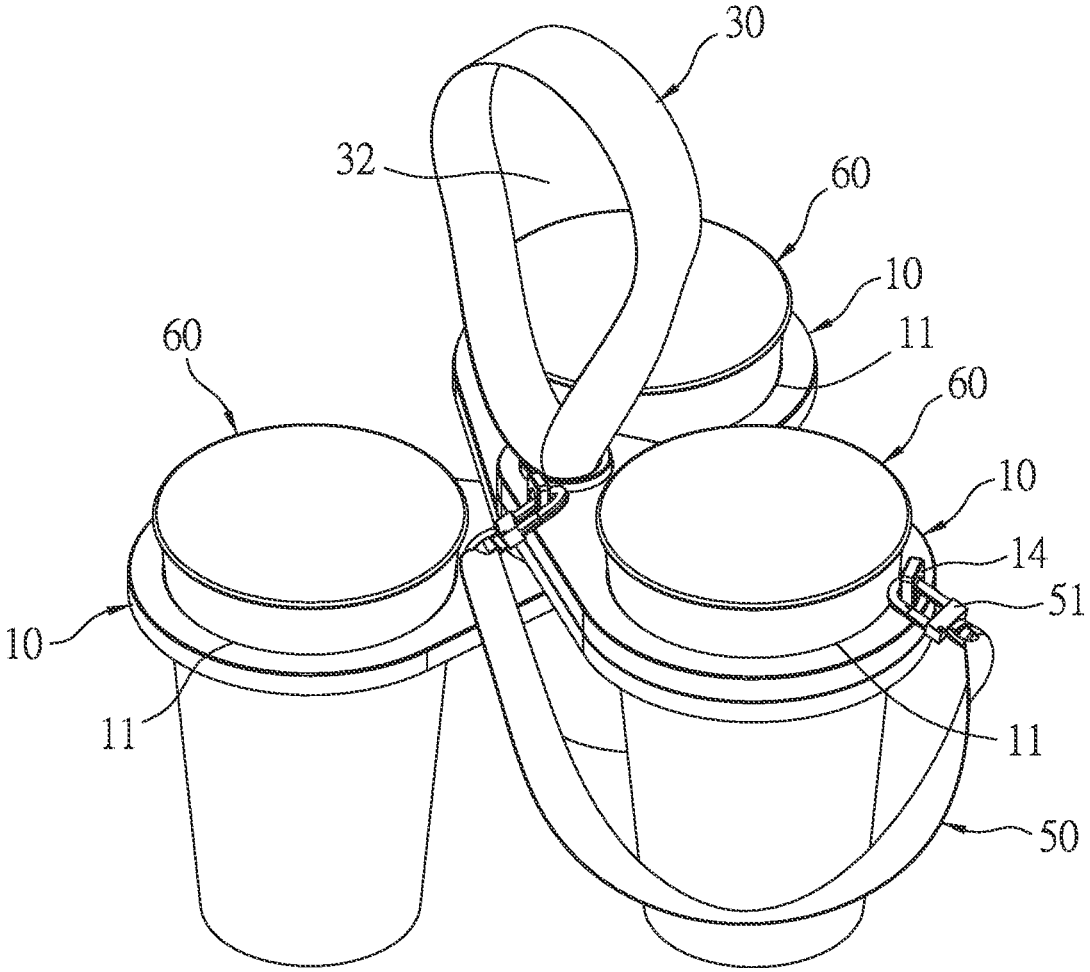
FIG. 7 is another perspective view showing the operation of the portable cup holder according to the preferred embodiment of the present invention.

As illustrated in FIG. 7, the multiple placing sheets 10 are rotated by the connection shaft 20 to separate the multiple placing sheets 10 into three portions of the multiple placing sheets 10, such that the multiple receiving orifices 11 of three portions of the multiple placing sheets 10 accommodate three drink cups 60, and the first carry strap 30 carries the three drink cups 60 together.

Figure 8:
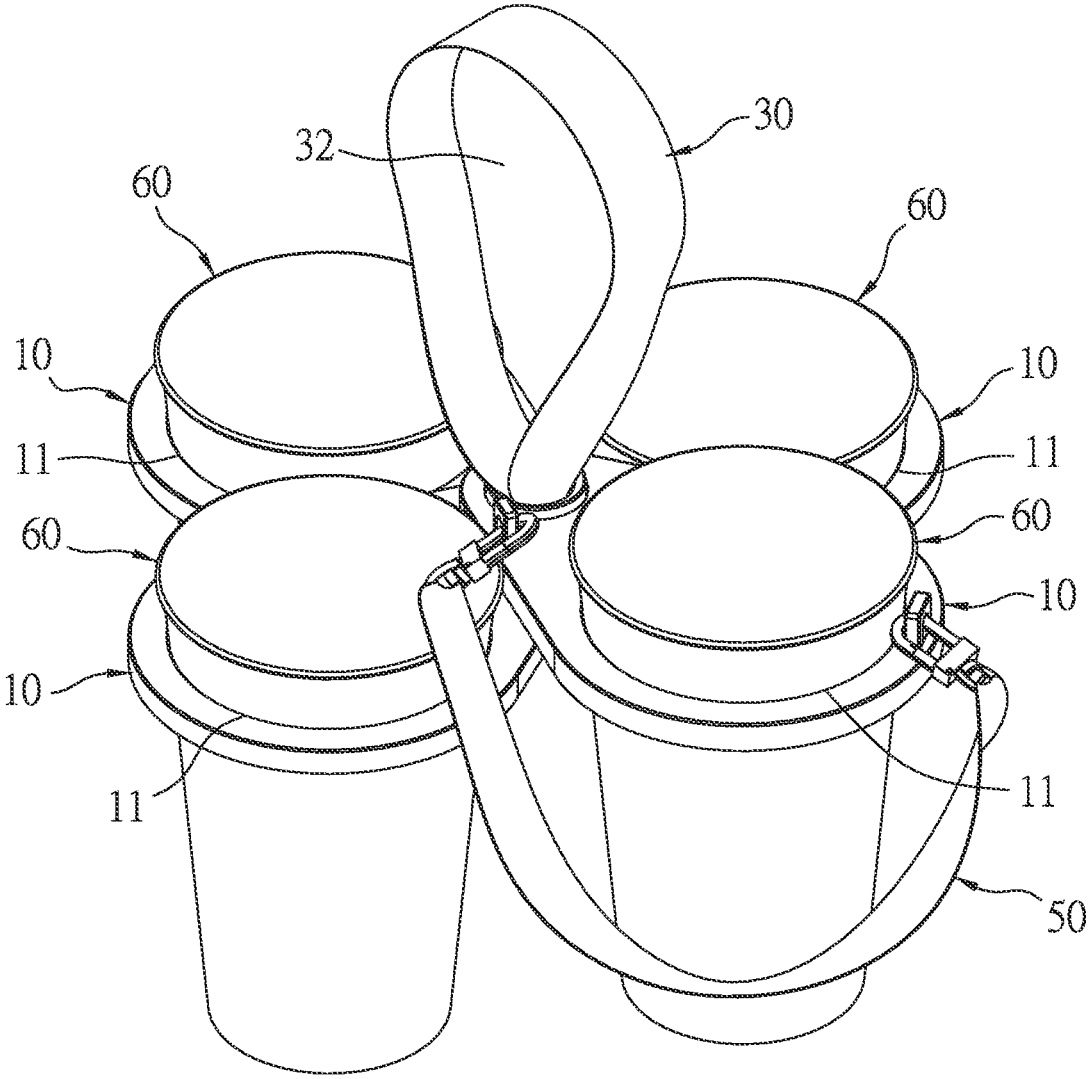
FIG. 8 is also another perspective view showing the operation of the portable cup holder according to the preferred embodiment of the present invention.

With reference to FIG. 8, the multiple placing sheets 10 are rotated by the connection shaft 20 to separate the multiple placing sheets 10 into four corresponding portions of the multiple placing sheets 10, such that the multiple receiving orifices 11 of four portions of the multiple placing sheets 10 accommodate four drink cups 60, and the first carry strap 30 carries the four drink cups 60 together.

Accordingly, the portable cup holder of the present invention has advantages as follows:

The multiple placing sheets 10 are adjustably rotated to align and stack with one another, hence the multiple placing sheets 10 are separated to one, two, three and four portions of the multiple placing sheets to carry at least one drink cup 60 (such as one, two, three or four drink cups), thus enhancing using convenience and utility.

While various embodiments in accordance with the present invention have been shown and described, it is clear to those skilled in the art that further embodiments may be made without departing from the scope of the present invention.

What is claimed is:

1. A portable cup holder comprising:

multiple placing sheets stacked, and a respective placing sheet including a receiving orifice defined on a first side thereof, and the respective placing sheet including a rotating orifice formed on a second side of the respective placing sheet;

a connection shaft inserted through the rotating orifice of the respective placing sheet to rotate the respective placing sheet along the connection shaft, wherein the connection shaft includes a hollow orifice and a partition post horizontally extending in the hollow orifice; and a first carry strap formed in a ring shape and including an accommodation space defined inside the first carry strap, the partition post of the connection shaft being received in the accommodation space of the first carry strap so that the first carry strap is connected with the connection shaft and is pulled to the partition post upward or downward.

2. The portable cup holder as claimed in claim 1, wherein a defining element is mounted below the partition post, and the defining element includes a through hole configured to connect with the first carry strap.

3. The portable cup holder as claimed in claim 1 further comprising a second carry strap, and a topmost placing sheet of the multiple placing sheets includes two connection seats, and the second carry strap includes two coupling portions formed on two ends thereof and configured to connect with the two connection seats of the topmost placing sheet.

4. The portable cup holder as claimed in claim 1, wherein the respective placing sheet further includes a largest-diameter segment and a small-diameter segment, the receiving orifice is defined on the first side of the respective placing sheet adjacent to the largest-diameter segment, the rotating orifice is formed on the second side of the respective placing sheet proximate to the small-diameter segment, wherein a topmost placing sheet of the multiple placing sheets further includes two connection seats located adjacent to the largest-diameter segment and the small-diameter segment.

5. The portable cup holder as claimed in claim 1, wherein the rotating orifice of a topmost placing sheet of the multiple placing sheets is two stepped shape.

6. The portable cup holder as claimed in claim 1, wherein the respective placing sheet includes a protruded fringe extending downward from a peripheral side thereof and a peripheral side of the receiving orifice.

7. The portable cup holder as claimed in claim 1, wherein the connection shaft includes an expansion portion extending from a top thereof, and the connection shaft further includes a locking ring screwed with a bottom thereof, such that the connection shaft fixes the multiple placing sheets by using the expansion portion and the locking ring.

8. The portable cup holder as claimed in claim 1, wherein the first carry strap includes two ends which are tied to produce a knot and to form in a ring shape.

9. The portable cup holder as claimed in claim 2, wherein the defining element is formed in a circular ball shape.

10. The portable cup holder as claimed in claim 3, wherein the two coupling portions of the second carry strap is a snap hook.

* * * * *